US008954209B2

(12) United States Patent
Burnett et al.

(10) Patent No.: US 8,954,209 B2
(45) Date of Patent: Feb. 10, 2015

(54) DETERMINING LOCOMOTIVE POSITION IN A LOCOMOTIVE CONSIST

(71) Applicant: Electro-Motive Diesel, Inc., LaGrange, IL (US)

(72) Inventors: Warren Douglas Burnett, Lee's Summit, MO (US); Mark Alan Fanara, Blue Springs, MO (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 141 days.

(21) Appl. No.: 13/678,381

(22) Filed: Nov. 15, 2012

(65) Prior Publication Data

US 2014/0136031 A1 May 15, 2014

(51) Int. Cl.
*G06F 7/00* (2006.01)
*B61C 17/12* (2006.01)

(52) U.S. Cl.
CPC ..... *B61C 17/12* (2013.01)
USPC ..... 701/19

(58) Field of Classification Search
USPC ..... 701/1, 19, 117, 537, 538
See application file for complete search history.

(56) References Cited

U.S. PATENT DOCUMENTS

| | | | | |
|---|---|---|---|---|
| 5,777,547 | A | 7/1998 | Waldrop | |
| 6,172,619 | B1 | 1/2001 | Lumbis et al. | |
| 6,456,937 | B1 | 9/2002 | Doner et al. | |
| 7,443,122 | B2 | 10/2008 | Tate et al. | |
| 2001/0044695 | A1 | 11/2001 | Doner | |
| 2012/0317282 | A1 * | 12/2012 | Kraeling et al. | 709/224 |

FOREIGN PATENT DOCUMENTS

DE 102007011144 B4 8/2010

* cited by examiner

*Primary Examiner* — Kim T Nguyen
(74) *Attorney, Agent, or Firm* — Baker Hostetler

(57) ABSTRACT

A method for determining order of locomotives in a locomotive consist is provided. Specifically, in a system wherein locomotives in a locomotive consist each include network interfaces having unique identifying criteria, such as IP addresses, the location of each locomotive relative to the lead locomotive may be accurately and automatically determined.

18 Claims, 1 Drawing Sheet

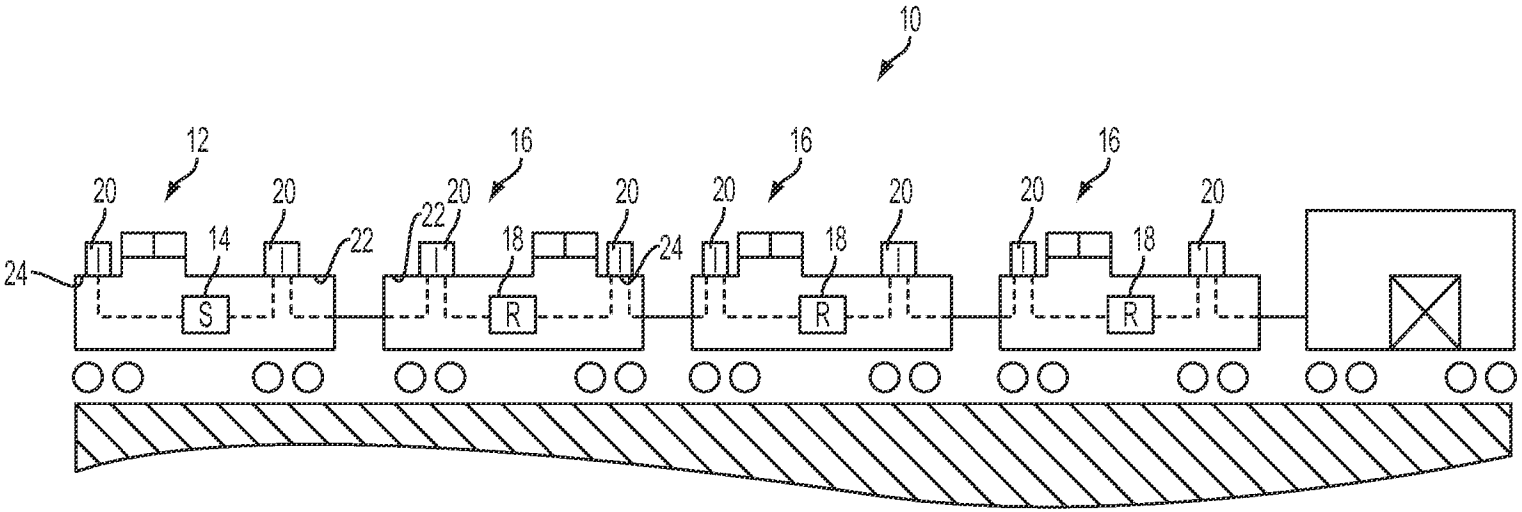
10
12
14
16
18
20
22
24
S
R

DETERMINING LOCOMOTIVE POSITION IN A LOCOMOTIVE CONSIST

TECHNICAL FIELD

The present disclosure generally relates to locomotive consists, and more particularly, methods and apparatuses for determining the specific order of locomotives behind a lead locomotive in a locomotive consist.

BACKGROUND

Initially, it is noted that the term "locomotive consist" means one or more locomotives physically connected together, with one locomotive designated as a lead locomotive and the others as trailing locomotives. A "train" consist means a combination of cars (freight, passenger, bulk) and at least one locomotive consist. Typically, a train is built in a terminal/yard and the locomotive consist is at the head end of the train. Occasionally, trains require additional locomotive consists within the train consist or attached to the last car in the train consist. Additional locomotive consists sometimes are required to improve train handling and/or to improve train performance due to the terrain (mountains, track curvature) in which the train will be travelling. A locomotive consist at a head-end of a train may or may not control locomotive consists within the train.

A locomotive consist is further defined by the order of the locomotives in the locomotive consist, i.e. lead locomotive, first trailing locomotive, second trailing locomotive, and the orientation of the locomotives with respect to short-hood forward versus long-hood forward. Short-hood forward refers to the orientation of the locomotive cab and the direction of travel. Most North American railroads typically require the lead locomotive to be oriented short-hood forward for safety reasons, as forward visibility of the locomotive operating crew is improved.

In a locomotive consist, it is generally important that the order and orientation of the locomotives is known to the operators of the lead locomotive as well as the computers controlling the locomotives. While there can be many reasons for this, at least one is that the order of the locomotives in the locomotive consist must be known so that the correct operating instructions can be sent to the correctly identified trailing locomotives. In the past, there have been automated and non-automated methods for determining the positions of locomotives in locomotive consists. One known method is for the operator to manually identify the locomotive order and manually record each locomotives relative position in the consist. However, this method is prone to potential operator error. Furthermore, it cannot be accomplished as quickly as desired, particularly when large consists are involved or if the weather is poor or dangerous.

There are known automated methods for determining the location of the locomotives in a locomotive consist. For example, US Publication No. 2001/0044695 entitled Methods and Apparatus for Locomotive Tracking describes a method and apparatus wherein a GPS system is used to determine the specific locations of the locomotives in the consist. However, the methods and systems described in the '695 publication can have problems. For example, GPS systems are prone to failure and/or can be disabled by cloud cover, weather, tunnels etc. Furthermore, not all locomotives in a consist may be equipped with the desired GPS equipment. These "ghost" locomotives must be accounted for manually by the operator thereby resulting in potential errors and inconsistencies for the reasons discussed above.

The disclosure herein is directed to overcoming one or more of these issues as set forth above.

SUMMARY

In one aspect, the present disclosure is directed to a method and apparatus for identifying the order/orientation of a locomotive in a locomotive consist once the lead locomotive has been identified.

In another aspect, the present disclosure is directed to a method and apparatus for identifying the order/orientation of a locomotive in a locomotive consist utilizing existing equipment that is generally present in existing locomotive configurations and that is generally not prone to frequent failure.

In another aspect, the present disclosure is directed to a method and apparatus for identifying the order/orientation of a locomotive in a locomotive consist using a network device, such as a server, located in the lead locomotive and the use of a utility function, such as a traceroute utility function, directed to network interfaces for network devices, such as routers, located in all of the trailing locomotives, wherein the network interfaces are each assigned unique identifying criteria, such as IP addresses.

BRIEF DESCRIPTION OF THE DRAWINGS

FIG. 1 is a diagrammatic illustration of a locomotive consist having an on-board computer network that may be used in accordance with the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and trailing changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and make part of this disclosure.

The present disclosure is directed to a method and apparatus for identifying the order/orientation of locomotives in a locomotive consist that is inexpensive to implement and relatively simple for an operator to use. More specifically, in an aspect, the present disclosure is directed to a method and apparatus for determining relative locomotive order in a locomotive consist that is not subject to inadvertent operator error and which does not rely on operation of onboard GPS tracking equipment.

More specifically, an aspect of the present disclosure includes a method and apparatus for identifying the order/orientation of locomotives in a locomotive consist wherein each locomotive in the consist includes a network device, such as a server and/or a router therein (or other electronic hardware capable of the connections and operations discussed herein as would be known to a person of ordinary skill in the art) and wherein each server/router, including network interfaces therefore, in each locomotive in the consist is sequentially connected by a hardwired connection to the network devices in the locomotives attached in front and/or behind that locomotive. Additionally, an aspect of the disclosure is directed to such a system wherein at least the network device in the lead locomotive is a network configuration device configured to assign identifying criteria, such as IP addresses using, for example, a Dynamic Host Configuration Protocol (DHCP), or any other protocol or method that may be used to assign IP addresses in computer systems, and each network device in the trailing locomotives are assigned an IP address from that device.

Specifically, the network configuration device (which may be a server, a router, or other electronic device as discussed above) may have a protocol, such as a DHCP (or other protocol), loaded thereon that may be used to configure network interfaces on network devices (such as routers, servers, or other electronic devices) so that the devices can communicate on an IP network. The network configuration device may use the DHCP (or other protocols) to acquire configuration information, such as IP addresses, default routes, and one or more DNS server addresses. The network configuration device may maintain a database of available IP addresses and configuration information. When the network configuration device receives a request, or otherwise is directed to assign IP addresses, from a client, such as a router, server, or other electronic device as discussed above, the network configuration device may then determine the network to which the requesting client is connected, allocate an IP address or prefix that is appropriate for the client to assign to one of its network interfaces, and may then send configuration information appropriate for that client.

In an embodiment consistent with the disclosure, each trailing locomotive may be equipped with a network device (such as a router/server/etc.) to act as a client in this construct (as well as for other purposes). In such an embodiment, each network device may have multiple interfaces to the computer network used by the locomotives (known as a trainline network) and each network interface may be capable of being associated with separate identifying criteria, such as an IP address. Specifically, such embodiment may preferably include each locomotive having at least one network device therein, each network device having at least two network interfaces associated therewith. Consistent with such an embodiment, one network interface may be associated (by electronic labeling and/or installation) with the short hood end of the locomotive and the other associated with the long hood end of the locomotive. In an aspect of an embodiment consistent with this disclosure, such interfaces, as well as the network device they are connected to, are sequentially connected to the network configuration device.

In an aspect of an embodiment consistent with the disclosure, it may be preferable for the identifying criteria associated with each of the network interfaces on the trailing locomotives be assigned using a protocol such that an interface associated with the long hood end of the locomotives are assigned identifying criteria, such as an IP address, having a certain pre-identified characteristic and an interface associated with the short hood end of the locomotives are assigned identifying criteria having a different pre-identified characteristic. For example, an odd value in the last octet in an assigned IP address might indicate a network interface indicating a short hood end of the locomotive, where, conversely, an even value for the last octet would indicate a network interface indicative of a long hood end.

Accordingly, as shown best in FIG. 1, in an embodiment consistent with the present disclosure, a locomotive consist 10 may include a lead locomotive 12 having a network configuration device 14 and at least one trailing locomotive 16, each trailing locomotive 16 having at least one network device 18 sequentially connected to the network configuration device 14 and any trailing locomotives 16 along the trainline network. In at least one embodiment consistent therewith, each network device 18 on a trailing locomotive preferably includes at least two network interfaces 20, each interface 20 capable of being assigned separate identifying criteria, such as an IP address, by an entity, such as the network configuration device 14, and each is capable of being associated with either a long hood end 22 or a short hood end 24 of a locomotive.

In an embodiment consistent with the disclosure, the network configuration device 14 in the lead locomotive 12 may initially assign identifying criteria, such as an IP address, to at least one network interface 20 for each trailing locomotive 16 in the consist 10. In cases where additional interfaces 20 are utilized on some (or all) of the trailing locomotives 16 in the consist 10, the network configuration device 14 may assign identifying criteria having a pre-identified characteristic associated with a long hood end 22 of a locomotive to interfaces 20 associated with the long hood ends 22 of the locomotives. Conversely, in such an embodiment, the network configuration device 14 may assign identifying criteria, such as IP addresses having a pre-identified characteristic associated with a short hood end 24 of a locomotive to interfaces 20 associated with the short hood ends 24 of the locomotives. The network configuration device 14 may, thereafter, initiate a protocol, such as a traceroute function to all of the interfaces 20 being assigned identifying criteria.

As is known by those of ordinary skill in the art, a traceroute function is a function available for use by a network device which, upon completion, reports the route (i.e. specific listing of the IP addresses traversed) between the device initiating the traceroute function and the desired destination IP address. A traceroute function accomplishes this by sending a series of echo request packets (usually using the Internet Control Message Protocol or ICMP), including in the packet a time limit value (known as a "time-to-live" or TTL), wherein the first TTL value is set at 1. Consistent therewith, the network device receiving the TTL decrements the TTL value by 1 before passing the echo request packet to the next network interface IP address in the chain unless, in doing so, the TTL reaches zero. When a network device receiving an echo request packet recognizes that the TTL has reached 0, that network device sends back a "time-exceeded" message to the network device that initiated the traceroute indicating at which network interface the TTL value was decremented to zero. Increasing the time limit value by 1, the network device initiating the traceroute function resends another ICMP packet along the network (in the present case, a trainline network) so that it will reach the next network interface destination along the sequential path. Upon reaching the next network interface 20 (one past the previous "last" network interface 20), the TTL value will once again be decremented to zero, and the network device 18 associated with that network interface 20 will, once again, send a time-exceeded message back to the network device that initiated the traceroute function, and so forth.

Consistent with the disclosed embodiment, wherein the device utilizing the traceroute function is the network configuration device 14, the network configuration device 14 maintains a record of the TTL number for every ICMP packet that is sent as well as the IP address of the network interface 20 associated with the network device 18 that sent the time-exceeded message when the TTL number for that packet was decremented to zero. This information enables the network configuration device 14 to determine which IP addresses, and consequently, which network interfaces 20 were reached and in what order. In this way, given that all of the interfaces 20 behind the lead locomotive 12 are sequentially connected, when the traceroute is completed, the network configuration device 14 in the lead locomotive can determine the order of all of the trailing locomotives 16 in its locomotive consist 10.

Industrial Applicability

The disclosed method and apparatus for determining the order of trailing locomotives 16 in a locomotive consist 10 finds potential application in any locomotive consist configuration regardless of engine type, style, propulsion, etc. Additionally, the disclosed method and apparatus finds potential application in determining orientation of locomotives 16 in a locomotive consist 20. Furthermore, the disclosed method and apparatus could potentially be used to determine the length, order, and orientation of all cars in a train if such cars were sequentially connected to a network configuration device 14 and equipped with necessary equipment (namely, network devices 18 such as routers/servers/etc.) having at least one (or more) network interfaces 20.

Consistent with an aspect of the disclosure, an order, and potentially, orientation, of trailing locomotives 16 in a locomotive consist 10 behind a lead locomotive 12 may be determined as follows. A network configuration device 14 on a lead locomotive 12 may initially be provided with a list of trailing locomotives 16, each having a corresponding network device 18 including at least one network interface 20 associated therewith, in its consist 10. As instructed by an operator, or automatically, sometime after all of the locomotives in the consist 10 are connected via a network, such as a trainline network, the network configuration device 14 in the lead locomotive 12 may assign IP addresses to some or all of the network interfaces 20 associated with the trailing locomotives 16 in its consist 10 to comprise a master list of IP addresses for the particular consist 10. Alternately, if IP addresses for the interfaces 20 had been previously assigned, the network configuration device 14 may simply record the existing IP addresses in connection with an identifier of the particular locomotive's network interfaces 20 to which they are assigned.

Next, the network configuration device 14 on the lead locomotive 12, either automatically or after being instructed by an operator, may begin a protocol, such as a traceroute function to all of the IP addresses associated with the network interfaces 20 consistent with the procedure discussed in detail herein. Specifically, the network interface 20 associated with the "time-exceeded" message received at the network configuration device 14 having the lowest initial TTL number, generally 1, is indicative of the interface 20 that is in closest proximity to the lead locomotive 12. Similarly, the IP address sending the "time-exceeded" message having the second lowest initial TTL number is indicative of the interface 20 that is in second closest proximity to the lead locomotive 12, etc. The network configuration device 14 on the lead locomotive 12 may then, by comparing the list and relative locations of the network interfaces 20 as determined using the traceroute function with the information the network configuration device 14 has relating to each such network interface 20 on each trailing locomotive 16 in the locomotive consist 10, establish an exact order of the trailing locomotives 16 in the consist 10.

Additionally, in a similar aspect consistent with the present disclosure wherein some (or all) of the trailing locomotives 16 have network interfaces 20 associated with either a long hood end 22 or a short hood end 24 of the locomotives 16, not only the location, but the orientation of the trailing locomotives 16 in the consist 10 may be determined. Specifically, in assigning identifying criteria, such as IP addresses, to the network interfaces 20 of the trailing locomotives 16, the network configuration device 14 may have information as to not only which interfaces 20 are associated with which locomotives 16, but also which interfaces 20 are associated with the long hood end 22 and short hood end 24 of each specific locomotive 16. Thus, by comparing this information with the results of the traceroute function discussed above, the network configuration device 14 may establish not just the order of the trailing locomotives 16, but their respective orientations as well.

What is claimed is:

1. A method for determining locomotive order in a locomotive consist, comprising:

selecting a lead locomotive having a first network device associated therewith;

selecting at least one trailing locomotive, each including at least one network device having at least one network interface associated therewith;

connecting said first network device to said network interfaces sequentially via a network;

assigning identifying criteria to said network interfaces;

sending requests to said network interfaces requesting said interfaces to send said requests to the next sequential network interface if a first predetermined condition is met and to alter the requests before sending the requests or to send a response to said first network device if a second predetermined condition is met, wherein said requests comprise echo request packets and said first predetermined condition is a time-to-live value greater than zero, said network interfaces alter the echo request packets by decrementing the time-to-live value by one prior to sending the requests to the next network interface and said second predetermined condition is a time-to-live value of zero and said response is a time-exceeded message.

2. The method of claim 1, wherein said first network device is a network configuration device.

3. The method of claim 1, wherein said identifying criteria are IP addresses.

4. The method of claim 3, wherein said IP addresses are assigned by said first network device.

5. The method of claim 1, further comprising assigning an order to each trailing locomotive based upon the time-exceeded message received by said first network device, wherein the trailing locomotive associated with the network interface sending the time-exceeded message associated with a lowest initial time-to-live value is assigned a position closest to the lead locomotive and the trailing locomotive associated with the network interface sending the time-exceeded message associated with a highest initial time-to-live value is assigned a position farthest from the lead locomotive.

6. The method of claim 5, wherein each trailing locomotive has at least two network interfaces associated therewith and wherein one of said network interfaces is associated with a short hood end of said trailing locomotive and wherein one of said network interfaces is associated with a long hood end of said trailing locomotive.

7. The method of claim 6, wherein assigning the identifying criteria to said network interfaces includes assigning the identifying criteria having a pre-identified characteristic to said network interfaces associated with said long hood end of said trailing locomotives and assigning the identifying criteria having a different pre-identified characteristic to said network interfaces associated with said short hood end of said trailing locomotives.

8. The method of claim 7, further comprising using the identifying criteria associated with said long hood ends and said short hood ends of said trailing locomotives to determine an orientation of said trailing locomotives in the locomotive consist.

9. A method for determining locomotive order in a locomotive consist, comprising:

selecting a lead locomotive having a network configuration device associated therewith;

selecting at least one trailing locomotive, each including at least one network device having at least one network interface associated therewith;

connecting said network configuration device to said network interfaces sequentially via a network;

assigning IP addresses to said network interfaces;

initiating a traceroute function, through said network configuration device, said traceroute function comprising sending of echo request packets having a time-to-live value associated therewith sequentially to each of said network interface IP addresses;

decrementing said time-to-live value by 1 when said echo request packets are received at each of said network interfaces;

sending a time-exceeded message to said network configuration device from said network interface when said time-to-live value equals 0; and assigning an order to each trailing locomotive based upon the time-exceeded messages received by said network configuration device, wherein the trailing locomotive associated with the network interface sending the time-exceeded message associated with a lowest initial time-to-live value is assigned a position closest to the lead locomotive and the trailing locomotive associated with the network interface sending the time-exceeded message associated with a highest initial time-to-live value is assigned a position farthest from the lead locomotive.

10. The method of claim 9, wherein the network configuration device assigns the IP addresses to the network interfaces.

11. The method claim 9, wherein each trailing locomotive has at least two network interfaces associated therewith and wherein one of said network interfaces is associated with a short hood end of said trailing locomotive and wherein one of said network interfaces is associated with a long hood end of said trailing locomotive.

12. The method of claim 11, wherein assigning the IP addresses to said network interfaces includes assigning the IP addresses having a pre-identified characteristic to said network interfaces associated with said long hood ends of said trailing locomotives and assigning the IP addresses having a different pre-identified characteristic to said network interfaces associated with said short hood end of said trailing locomotives.

13. The method of claim 12, further comprising using a identifying criteria associated with said long hood ends and said short hood ends of said trailing locomotives to determine an orientation of said trailing locomotives in the locomotive consist.

14. The method of claim 9, wherein said network configuration device is a server.

15. The method of claim 14, wherein said network configuration device is configured to assign the IP addresses using a Dynamic Host Configuration Protocol.

16. The method of claim 9, wherein said network devices are routers.

17. The method of claim 9, wherein said echo request packets are sent using a Internet Control Message Protocol.

18. The method of claim 9, wherein said network devices are connected via a trainline network.

* * * * *